US005209481A

United States Patent [19]

DeBack

[11] Patent Number: 5,209,481

[45] Date of Patent: May 11, 1993

[54] GOLF SWING MUSCLE STRENGTHENER AND SWING DEVELOPER DEVICE

[76] Inventor: James A. DeBack, 3443 Baywood Cir., Antoich, Calif. 94509

[21] Appl. No.: 793,507

[22] Filed: Nov. 15, 1991

Related U.S. Application Data

[63] Continuation-in-part of Ser. No. 776,680, Oct. 11, 1991, abandoned, which is a continuation of Ser. No. 561,018, Jul. 31, 1990, abandoned, which is a continuation-in-part of Ser. No. 463,552, Jan. 11, 1990, Pat. No. 4,984,801.

[51] Int. Cl.[5] ..... A63B 69/36

[52] U.S. Cl. ..... 273/186.2; 273/193 A; 273/194 B

[58] Field of Search ..... 273/186 A, 186 C, 191 R, 273/193 R, 193 A, 194 B, 77, 186.2, 186.1; 482/20-22, 106-110, 50

[56] References Cited

U.S. PATENT DOCUMENTS

| | | | |
|---|---|---|---|
| 1,333,005 | 3/1920 | Warner | 482/110 |
| 1,930,342 | 10/1933 | Graham | 273/35 |
| 2,482,015 | 9/1949 | McConnell | 273/194 R |
| 3,351,346 | 11/1967 | Strahan | 273/193 |
| 3,722,890 | 3/1973 | Wieboldt | 273/186 A |
| 3,740,053 | 6/1973 | Eiger | 273/194 B |
| 3,758,117 | 9/1973 | Harrison | 273/194 B |
| 3,820,795 | 6/1974 | Taylor | 273/186 A |
| 4,170,356 | 10/1989 | Banks | 273/186 A |
| 4,381,111 | 4/1983 | Richards | 273/191 R |
| 4,444,396 | 4/1984 | Wendt | 273/193 A |
| 4,602,788 | 7/1986 | Wendt | 273/193 A |
| 4,664,388 | 5/1987 | Huber | 273/194 B |
| 4,682,775 | 7/1987 | Wood | 273/186 C |
| 4,754,978 | 7/1988 | Dworacek | 273/77 R |
| 4,842,280 | 6/1989 | Hilton | 273/194 B |

FOREIGN PATENT DOCUMENTS

| | | | |
|---|---|---|---|
| 437905 | 11/1935 | United Kingdom | 273/186 A |
| 472237 | 9/1937 | United Kingdom | 273/194 R |

*Primary Examiner*—Benjamin H. Layno
*Attorney, Agent, or Firm*—Schapp and Hatch

[57] ABSTRACT

A golf swing muscle strengthener and swing developer device having a suitable structural member attached to a golf handle. The member may be curved or made up of L shaped members that are clamped to the handle. If L shaped members are used, they are slidably connected to each other. Weights suspend from the member so that they are directly below the golfer's grip. If a curved member is used, a means for adjusting weights is provided so as to locate the weights properly. At least one weight is suspended from the member by a single member or a member made up of the two parts: two members that permit one to telescopically side into the other. There is no restraint of the weights at their upper end so that when they move a sound is heard and vibration is observable; however, as the user becomes acquainted with the feel of a correct swing, an upper restraint may be added. If the noise or vibration are not easily observable, a light or sound generating device or a combination of both may be provided.

37 Claims, 6 Drawing Sheets

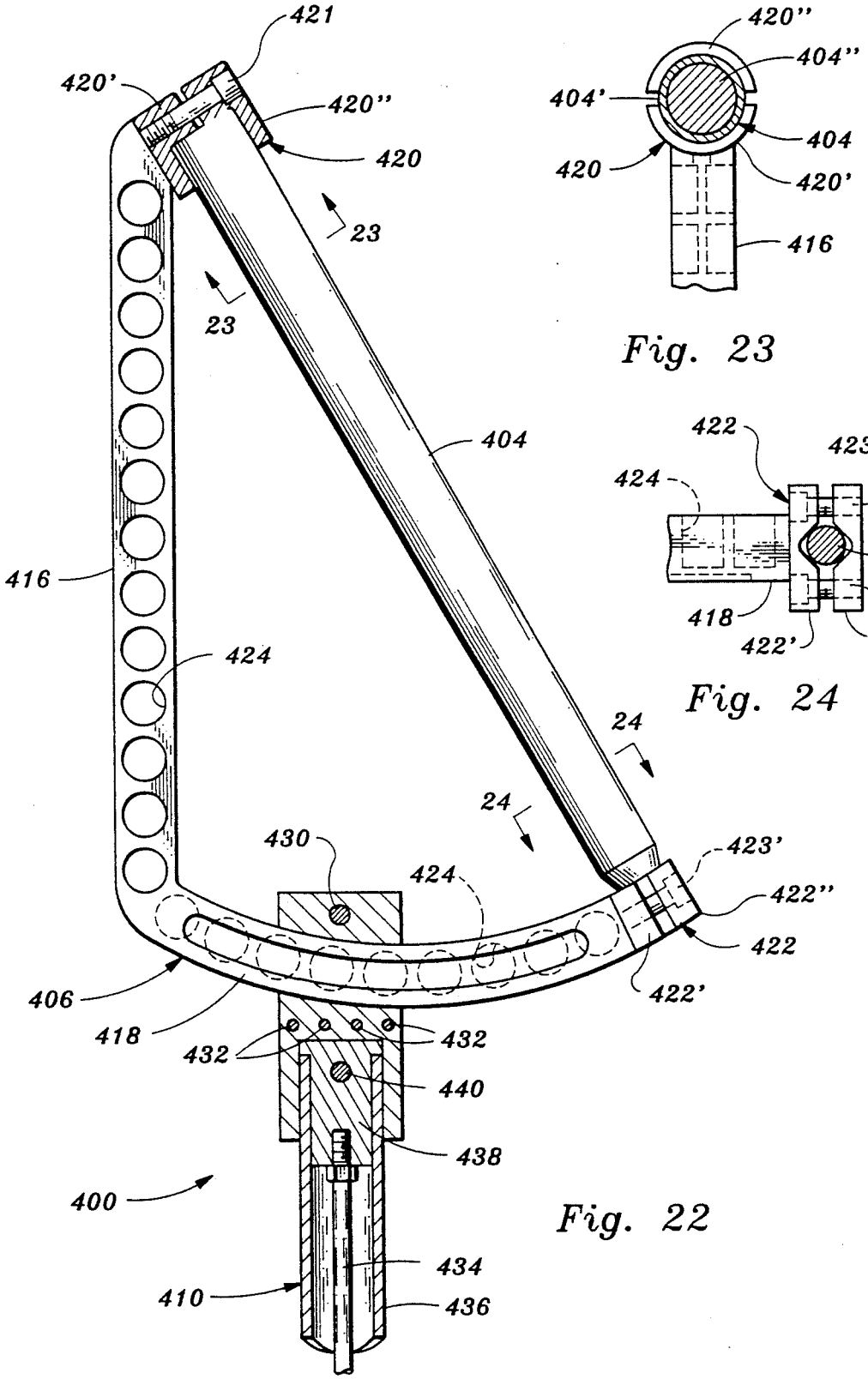
Fig. 23
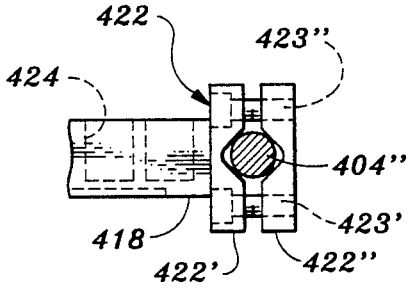
Fig. 24
Fig. 22

GOLF SWING MUSCLE STRENGTHENER AND SWING DEVELOPER DEVICE

This is a continuation-in-part of copending application Ser. No. 07/776,680 filed on Oct. 11, 1991 now abandoned, which is a continuation of co-pending application Ser. No. 07/561,018, filed on Jul. 31, 1990 now abandoned, which is a continuation-in-part of application Ser. No. 07/463,552, filed Jan. 11, 1990, now U.S. Pat. No. 4,984,801.

BACKGROUND OF INVENTION

1. Field of the Invention

My invention relates to golf stroke training apparatus, and more particularly to golf stroke training apparatus comprising handle means, weight means, and positioning means for so fixedly positioning said weight means with respect to said handle means that when said handle means is propelled through a correctly executed golf stroke said weight means is substantially directly below said handle means at the bottom of said stroke.

2. Discussion of the Prior Art

In the specification and the claims, I will use terms such as "target line", "swing line", "swing plane", and "club face square to the swing line", so as to eliminate doubt as to their meaning, I will now define these terms. "Target line" means an imaginary line that extends through a golf ball to the target (a point on the golf course which is the immediate objective that the golfer wishes to reach). The "swing plane" is the angle of the swing to the ground. In a good swing, the club head travels around the golfer's body on a plane or imaginary line that runs through the shoulder area to the target line. The "swing line" is the horizontal projection of the swing plane. In other words, if an observer climbed a tall pole directly behind a golfer to a point on the pole above the golfer's head and looked down at the swing plane and the golf club left a trail behind as it traveled the swing plane, the swing line would appear as an arc of a circle with the golfer as the center of the circle. "Lie angle" is the angle the club makes with the ground when the bottom of the club head is flat on the ground and the golfer assumes a correct stance. When I refer to the "club face square to the target line," I mean that the leading edge of the club head is at right angle to the target line at the point the golfer would hit the ball. The "club face square to the swing line" means that the leading edge of the club head is at a right angle to the swing line.

There are several patents that I am aware that inventors in the past have invented to come up with an apparatus to improve a golfer's swing. I will now discuss them below:

Great Britain Patent 437,905 describes a golf club that may be used to develop a smooth backswing, body turn and down swing. The club handle has a detachable section that becomes misaligned with the rest of the shaft when a faulty golf swing is used with the golf club. The apparatus that accomplishes this includes a handle that has a looped end that connects at the location on the handle just below where the misalignment occurs. The club can be used as an ordinary club by twisting a tab member so that the tab member lines up with the bearing, which is at the end of the displaceable handle section. The tab prevents the bearing from moving which in turn prevents misalignment. The displaceable section, as mentioned, includes a bearing at its lower end. The amount of resistance the bearing must overcome to result in misalignment is a function of the force exerted by the bearing on the lower portion of the club which in turn is a function of the force an adjustable spring exerts against the bearing.

U.S. Pat. No. 1,930,342 describes a golf club that prevents jerking and lunging, and develops balance and control. The user of this invention can detect an imperfect swing because a vibration and jerkiness is felt while swinging. The invention includes a golf club which has, instead of a head, a swivel connected to one end of the shaft. A chain is connected at one end to the swivel and at its other end to a balanced pear shaped weight. After gripping the handle, the weight is lowered to the ground, and with the proper stance the club is drawn back. If the forwardswing is started prematurely, a quick jerk is felt by the golfer. This is caused by a sudden change in direction from the backswing to the forwardswing in an improper golf swing.

U.S. Pat. No. 2,482,015 and U.S. Pat. No. 4,664,388 describes a structural member connected to the handle portion of a golf club. A flexible cord extends from the structural member to a position directly below where a golfer grips and a weight is connected to the free end of the cord, whereby the weight is suspended below the golfer's grip.

U.S. Pat. No. 3,351,346 describes an invention to perfect an "inside-out" swing to obtain maximum range and accurate directional control of the club. The invention also makes possible development of the muscles used in a golf swing. The invention has a typical golf club handle which ends in a downwardly curving portion. In this curving portion, a removable weight(s) is located. The inventor mentions that the user should progress from a weight one-1¼ pound to six such weights. The inventor further points out that the angle between the hand and curving portion is critical because if its too great the weight will strike the golfer's shoulders; and if too small, the weight will not be behind him. The inventor points out that this angle should be approximately 47½ degrees to remove these concerns.

U.S. Pat. No. 3,772,890 describes an invention which, through sound and vibration, a golfer learns when his swing has reached the end of his backswing. The invention also leaves a divot in the ground as it hits the ball. The direction of the divot allows the golfer to determine if his swing at ball contact is on the correct path. The invention includes a nylon rope loop that is connected to a weight. The loop is placed over the golf club and allowed to settle to the base of the shaft (adjacent to the head). When the golf club is swung back, its motion stops at the end of the swing. However, the weight continues on under its own momentum until it suddenly stops due to the restriction on its travel caused by the nylon rope. This causes the weight to snap back and hit the club head emitting a sound and vibration along the shaft so as to let the golfer know the top of his backswing has been reached.

U.S. Pat. No. 3,740,053 describes an invention in which a removable weight is added to a golf club prior to an official swing. The inventor contends the added weight "provides an excellent way to limber up ones muscles." The weight comprises a pliable member which is snapped onto the longitudinal center of gravity. (The center of gravity is found by balancing the club on ones finger.) Next a smooth shield is snapped over the pliable member so the open end of the shield is opposite the open end of the member. This combination is held in place by a spring like element that narrows in diameter along its length. The wider end of the element is the end that is first inserted over the pliable member and shield.

U.S. Pat. No. 3,758,117 describes an invention to aid a golfer to acquire a consistent follow-through. The invention includes a weight that is adjusted along a rotatable arm that is in turn connected to the lower end of the golf club shaft through a clamp. The weight is so positioned on the arm so that it swings parallel with the club head so as to exert a force to pull the head and the golfer's hand through the swing after hitting the ball. The location of the weight requires several critical adjustments.

U.S. Pat. No. 3,820,795 describes an invention that permits self-analysis of one's golf stroke by using peripheral vision and the stroboscopic effect of light. The invention comprises a member that has frusto-conical member that slides down the shaft and is located on the lower end of the golf shaft at the hosel. Integral to the member is a tab with a hole of suitable diameter to accommodate a flashlight. When the flashlight is turned on and inserted in the tab, the golfer can track his swing with his peripheral vision which in turn trains the golfer to keep his head down.

U.S. Pat. No. 4,170,356 describes an device that includes a rod that has a soft resilient tip at its free end. The rod is mounted to the upper portion of the golf shaft through a mounting assembly which mounts the device on the golf shaft. The device, after it is located on the golf shaft, is adjusted by a professional golfer so that the free end of the rod will lightly touch the golfer's shoulder when the club has attained its proper position at the end of a well executed backswing.

U.S. Pat. No. 4,444,396 and 4,602,788 are similar in that both inventions use a regulation shaft less the head. At the lower end of the shaft were the head is normally found, one or more circular discs of various weights may be located and held in place by a releasable means on top of weights so that the weights may be removed by slipping them up the shaft and over the handle.

U.S. Pat. No. 4,682,775 and United Kingdom Patent 472,237 disclose a structural member connected to a golf club shaft below the handled. A weight is suspended from the structural.

U.S. Pat. No. 4,842,280 describes a removable weight that may be secured over the club head. A weight is located in each of the interconnected envelopes that are integral and symmetrical. The envelopes fold over the club head. The envelopes are held in place by straps that circumscribe the heel and toe of the club head but not its sole or bottom.

From the above one can see that there have been many attempts to produce a practice club that will correct or improve a golfer's swing in one or more ways. But none of the aforementioned patents have disclosed an invention that is embodied with the components and that functions as mine does. That is, one that has sufficient weight so located that when the club with my invention connected to it is swung, the plane the weight swings in appears to be fixed. This fixed plane naturally forces the golfer to swing the club in a plane parallel to the weight plane resulting in a more perfect swing. The reason the plane of the weights appears to be fixed is that, if sufficient weight is used, the golfer can only by great exertion move the weights out of the plane the weight travels in when swung by the golfer when the golfer takes a normal stance with a normal waist turn. I refer to the arm motion that corresponds with the weight motion as a natural pendulum motion.

As mentioned, this is done using a golf club without modifying or removing any components of the club such as its handle (G.B. 437,905), or its head (U.S. Pat. Nos. 1,930,342, 3,351,346, 4,444,396 and 4,602,788). Further, intended purpose of U.S. Pat. No. 3,772,890 is to determine when a golfer reaches the top of his backswing and also determine the flight path of the head at ball contact by looking at the divot this invention makes in the ground. This invention does not locate weights that results in correct swing that arises out of the pendulum motion of the weight. And U.S. Pat. No. 3,758,117 locates a rather complicated weight at a position near the club head. In contrast, my invention locates the weight so a pendulum action results by using conventional weights that may be increased or decreased as the user desires. Pat. No. 3,740,053 is an invention that is used to limber the golfer's muscles, but it does not improve the golfer's swing as my invention does. On the other hand, U.S. Pat. No. 3,820,795 is an apparatus that allows the user to watch his stroke through the stroboscopic effect of light. But this patent does not teach a means to develop one's golf swing through the use of a weight in the manner I teach. U.S. Pat. No. 4,170,356 describes an invention that is limited to a means that lets the golfer know when he has reached the top of his swing. None of the above mentioned patents nor U.S. Pat. Nos. 2,482,015; 4,664,388; 4,682,775; 4,682,775; and United Kingdom Patent 472,237 disclose my invention as further pointed out below.

My invention, on the other hand, maximizes one's swing by developing a swing that follows golf's five "flight laws of impact geometry" so as to result in a straight long distance ball flight. These laws are: club head path (the line that the club takes towards the ball, at contact of the ball and thereafter); position of the club face to the club head path; the angle of attack to the ball; squareness of contact, that is, hit the ball in the middle of the club head; and club head speed. This is done by (a) clamping the golf club to my invention so that the weight is directly below the golfer's hands when the club head is in line with the invention and the golfer places the golf club in the proper lie angle for that individual and (b) swinging my invention so that a half back and forward pendulum motion is achieved, that is, the shaft of the club is parallel to the ground and the club head is pointing up and perpendicular to the ground at the end of both the back and forward half swing; while at all other points during, the swing the club head is square to the swing line. In order to develop the timing necessary to achieve squareness of the face of the club head to the target line at point of impact or contact to the ball as the face of the club head is moving square to the swing line, the weight of my invention must not be allowed to twist on my invention through the down swing or the forward swing. If it does, a noise is made by the unrestricted weights of my invention as they twist on my invention because of an improper swing which in turn causes a vibration through the shaft. The twist of the weights is seen, and the corresponding vibration and noise are heard and felt by the golfer. This alerts the golfer of the improper swing.

Further none of the above inventions alone or in combination teach my invention, which has a weight(s)

insertable onto a structural member, and a removable means for retaining the weight, located below the weight as well as other features of my invention described below.

SUMMARY OF THE INVENTION

The invention relates to an apparatus that permits the user to both exercise and develop the right muscles used in the user's golf swing as well develop a geometrically correct swing.

When the invention is used, weights swing back and forth naturally while the user controls the golf club by a mechanically correct swing. More specifically, tubing or other suitable structural shape is attached to the golf handle. The member may be straight, curved or made up of L shaped members that are clamped to the handle. If L shaped members are used, they are slidably connected to each other. If a curved member is used, a means for adjusting the weights is connected to the curved member so that after adjustment of the weight, the weight lies directly below the hands when the golfer assumes a correct stance with the corresponding lie angle. The weight should hang directly below the hands, which grip the golf club handle. The distance the weights are below the hands is determined by the users's height, posture, length and the lie angle of the golf club. The weights hang down from the curved member by a single member or a member made up of the two parts: two members that permit one to telescopically slide into the other. They are held in place by a pin that fits through a hole located in each of the members. Weights are located over the bottom end of the lower of the two members and are held in place at the lower end of the weight by a removable retaining means. The weights may also be inserted over the top of the vertical member and then held in place by a retaining means that is pressed into the member. I will also describe in more detail weights that may be inserted sideways onto the vertical member.Generally, no restraint of the weights is provided at their upper end.

DESCRIPTION OF THE DRAWINGS

FIG. 22 is a partial elevational view, partially in section, of the golf stroke trainer of my invention shown in FIG. 20.

FIG. 23 is a partial sectional view of the golf stroke trainer of my invention shown in FIG. 22, taken on plane 23—23 of FIG. 22.

FIG. 24 is a partial sectional view of the golf stroke trainer of my invention shown in FIG. 22, taken on plane 24—24 of FIG. 22.

DESCRIPTION OF THE PREFERRED EMBODIMENT

In using the golf stroke training apparatus of my invention, the golfer both exercises and develops the correct muscles used in the golfer's swing. And by repeated use of my invention, a correct swing becomes the natural swing of the golfer. The correct swing results in the golf ball traveling in a straight path for maximum distance.

Many of the golf stroke training apparatuses of my invention fall into one of two broad categories, viz., attachments to be attached to golf clubs, herein called "attachments", and devices which are complete in themselves and do not require the provision of a golf club, which are sometimes called "trainers" herein.

The golfer who uses my invention swings the golf club and my invention back only to a point that the club is parallel to the ground and the club head is toe up and then forward to a point the club is again parallel to the ground and the club head is toe up. This is repeated until this part of the golf swing becomes natural to the golfer. As mentioned, a correct golf swing results provided (1) the lie angle is set up for the golfer, and (2) there is sufficient weight to prevent wrist movement so the club will not swing off the correct swing plane required for maximum straight ball flight. The exact amount of weight depends on the golfer. At times I use 30 pounds. Another golfer may use more or less weight depending on the golfer's strength.

Figure 1:
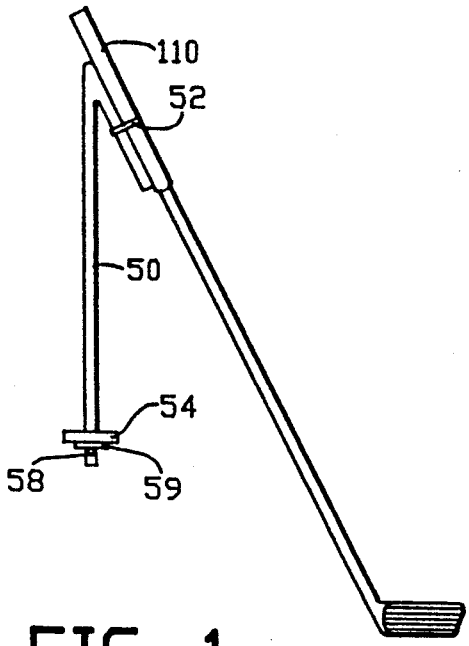
FIG. 1 is an elevation view of my invention connected to a golf club.
Figure 2:
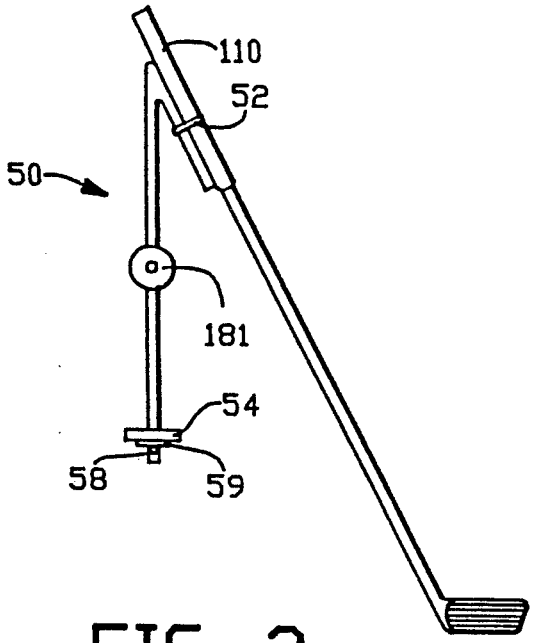
FIG. 2 illustrates the structural member as two portions interconnected by a rotational means.
Figure 5:
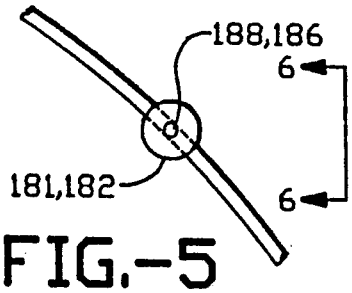
FIG. 5 illustrates another means for adjustablely connecting two members of my invention.
Figure 6:
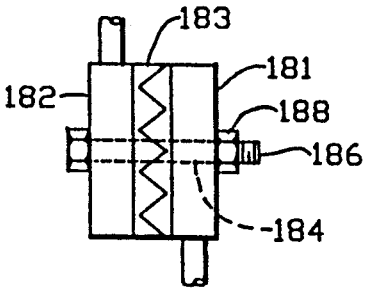
FIG. 6 illustrates a side view of the means illustrated in FIG. 5.

The invention is connected to a golf club having an elongated shaft and a handle portion at the upper end of the shaft and a club head at the lower end of the shaft. However, it may be used with any elongated shaft that approximates a golf club shaft. As illustrated in FIG. 1, a structural member 50 may be adjustablely connected to the handle portion 110 by a means for connecting it thereto such as clamp 52. The structural member extends down as illustrated in FIG. 1 to a location directly below where a golfer grips the club. A weight 54 is inserted over the lower end of the structural member so that the weight is directly below a golfer's hands while the golfer swings the club head square to a swing line. The weight is held in this position by a retaining means located below the weight. The retaining means is illustrated as pin 58 and washer 59. The structural member may be constructed into two portions as illustrated in FIG. 2. As illustrated in FIGS. 5 and 6, the two portions are rotationally connected by two serrated members 181, 182 that are connected respectively to the ends of the portions of the structural member which they join. These serrated members have serrations 183, FIG. 6, projecting from one side of each member and a hole 184 located centrally in each. A bolt 186 is slid through the hole; and, when the correct orientation of the first member is determined, the serrated members are locked into place by securing the nut 188 to the bolt.

Figure 3:
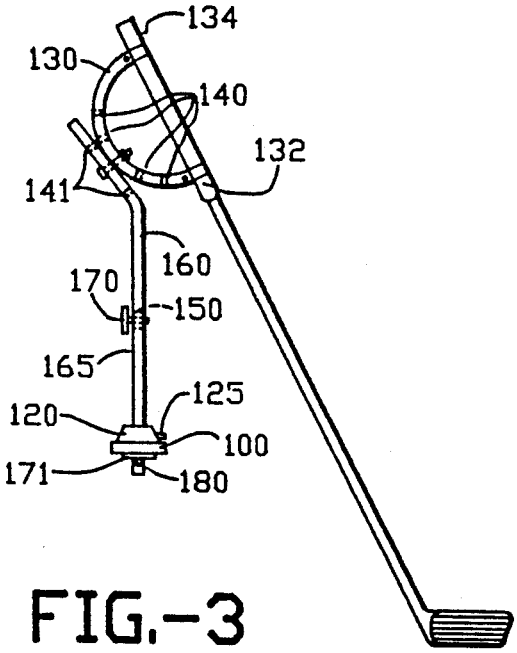
FIG. 3 illustrates the structural member as a member made up of a curved member and a member on which the weight is located.

The structural member may alternatively be a structural member 130, FIG. 3, which is curved and attached to the golf handle at each end of the handle and the curved member by clamps 132, 134. A plurality of holes 140 are drilled in the curved member 130 to connect a first member 160. The first member may have a curved upper portion that has a plurality of such holes 141 fabricated in the curved upper portion. A means is provided to adjustablely connect the first member to the curved member for lie angle adjustment so that the weights are directly below the hands when the user takes a correct stance with the club head flat on the ground. This connecting means is discussed below. With the proper weight so that the golfer's wrists do not turn during the forward and backward halfswing, the leading edge of the club face remains square to the golfer's swing line.

Figure 4:
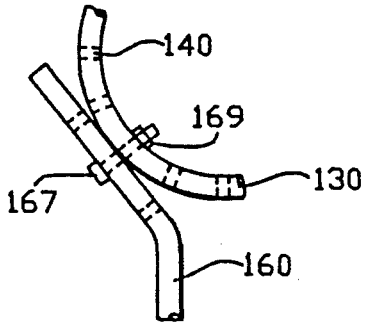
FIG. 4 illustrates in more detail the means for connecting the curved member and the first member of the invention of FIG. 3.

The lie angle adjustment of the weights (that is the adjustment of the weights so that they are below the hands of the golfer with the golf club's lie angle) can be fixed in the appropriate position by inserting at least one bolt 167 in a hole in both the curved member and the first member and secured in place by nut 169, FIGS. 3 and 4. If additional strength is required at this connection for any reason, then a plurality of bolts may be located through the appropriate holes in each of the members. Thus one example of the means for connecting the curved member to the first member is at least one bolt 167 located through a hole in both the curved member and the first member which is secured by a nut 169 so as to maintain the desired orientation of the two members.

Figure 7:
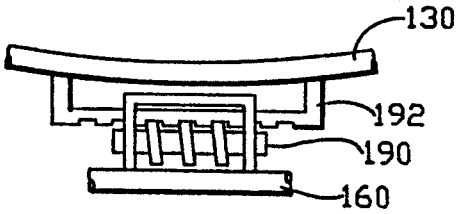
FIG. 7 illustrates yet another means for connecting the curved member to the first member.

Another example of the adjustable means is a pair of one sided serrated members 181, 182, FIG. 5. As described above, these serrated members have serrations 183, FIG. 6, projecting from one side of each member and a hole 184 located centrally in each. A bolt 186 is slid through the hole; and, when the correct orientation of the first member is determined, the serrated members are locked into place by securing the nut 188 to the bolt. Yet another example of the adjustable means includes a gear and gear rack 190, 192, FIG. 7, wherein the gear is rotationally connected to either the curved member or the first member and the gear rack is connected to the other member. In this arrangement, the gear and gear rack engage each other so that when the gear is rotated it moves along the gear rack and in turn moves the weight to its proper location.

Figure 8:
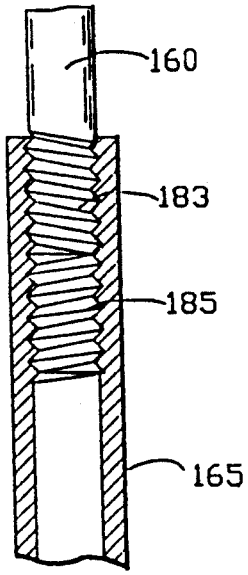
FIG. 8 illustrates an alternate method for connecting the first and second members.

As illustrated in FIG. 3, the first member 160 may telescopically slide over or into or is otherwise adjustablely connected to the second member 165. They are held in place by pin 170 that fits through hole 150. A plurality of such holes may be provided in the first and second members so that the second member can increase or decrease the distance of the weight below the golfer's hands. (The second member may not be needed in those cases were the first member is long enough to get the weight the proper distance below the hands.) Weights are located over the bottom end of the second member 165 (or if the second member is not used, the first member) and held in place by removable retaining means such as pin 180 and washer 171 or threading the lower end of the second member (or first member) and connecting a nut to the threads so that the nut is below the weight. Another means for adjustablely connecting the first and second members is fabricating male 183 and female 185 threads in the members as illustrated in FIG. 8 so that one member may be screwed into or out of the other.

The top of the weight or weights are not secured so that if an incorrect swing occurs, the weight's movement causes a vibration to be felt in the shaft and a noise or sound due to the weight movement to be heard by the golfer. The golfer should also see the movement or rotation of the weights. This will not occur with a correct swing. After the golfer gets use to the proper swing, the golfer may find it useful to secure the upper end of the weight by a removable retaining means insertable onto the first member or the second member as the case may be. This can be done by clamping weights 100 in place by a collar 120 which is held in position by a set screw 125, FIG. 3.

One of the major benefits of my invention is that a correct swing occurs naturally. A poor swing must be induced by the golfer through the exertion of extra force. By repeating the swing, a good swing becomes the golfer's natural swing.

Figure 10:
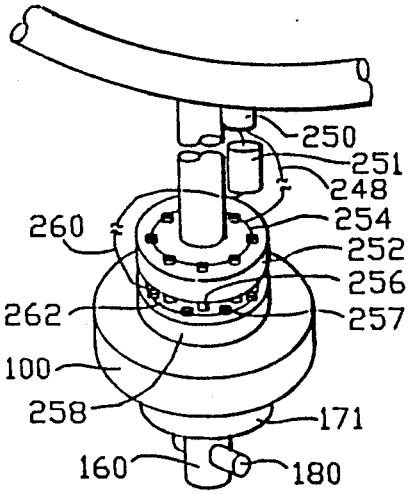
FIG. 10 illustrates one way to generate a noise when the weights of my invention twist indicating an incorrect swing.

I have found that some people may not hear the noise or feel the vibration generated by an improper swing; although the golfer should see the movement if its large enough. In order to draw attention to this, I may include with my invention a means to generate a noise, a light or both which are set off when the weights twist due to an improper swing. There are many ways to do this as understood by those skilled in the art. I illustrate in FIGS. 10–12 several examples of such means. FIG. 10 illustrates a means to generate a noise. The means includes an electrical relay 250 which may be attached to my invention. The relay is electrically connected by wire 248 to a first electrical conductor 254 that is located on a first insulating member 252. The electrical conductor in turn is connected to electrical contacts 256 that passes through the first insulating member. The contacts are equally spaced from each other. Another wire 260 interconnects the relay and a second electrical conductor 262 that is attached to a second insulating member 258 that has electrically conducting contacts 257. The second insulating member is connected to the weight 100 by glue, fasteners or other appropriate ways so that the two move together. Thus if the weight twists, a closed electrical circuit results when the electrical contacts 256 and 257 of members 252 and 258 touch resulting in the flow of electricity which in turn closes the contacts of the relay making a clicking sound. The source of electromotive force is battery 251 which is connected electrically in series with the relay and the contacts as illustrated in FIG. 10.

Figure 11:
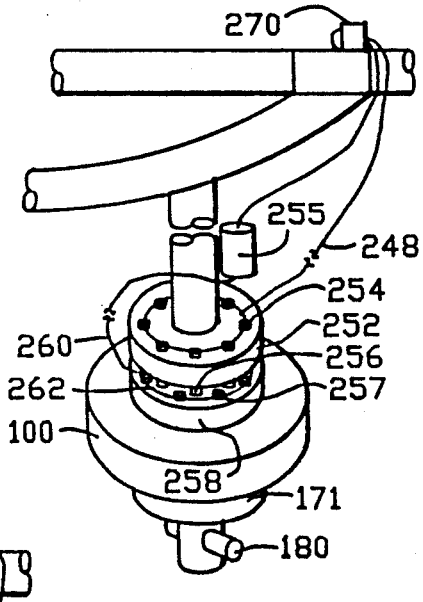
FIG. 11 illustrates one way to generate a light when the weights of my invention twist indicating an incorrect swing.

This can be similarly done with a light 270, FIG. 11, which works in the same manner as the circuit illustrated in FIG. 10, except the electric current causes the light to go on in lieu of closing the relay. The source of electromotive force in the light circuit is battery 255.

Figure 12:
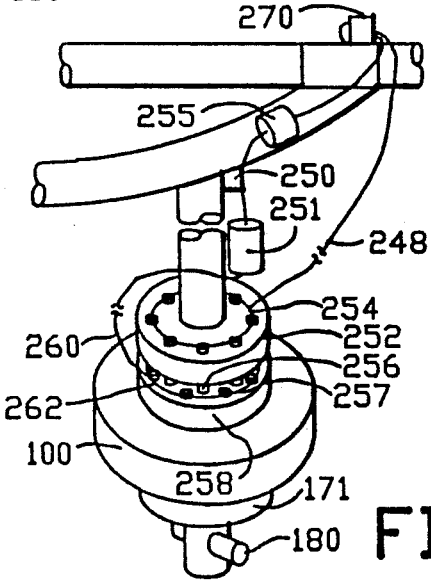
FIG. 12 illustrates a combined noise and light circuit that is activated when an incorrect swing occurs.

The two circuits may be combined as in FIG. 12, so that an improper swing will generate both a noise and a light. As before the source of electromotive force for the relay is battery 251. Once the relay clicks closed, the light circuit also is closed so that the current from battery 255 causes the light to go on.

There are may be other ways to generate the noise and light. For example, the noise may be generated mechanically so as to produce a clicking sound or some other sound as well as by other electrical circuits known by those skilled in the art.

Figure 9:
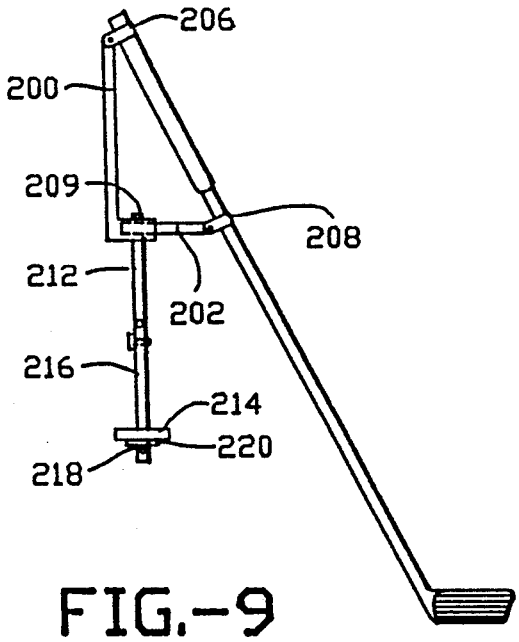
FIG. 9 illustrates an alternate embodiment of my invention.

Another embodiment of my invention is illustrated in FIG. 9. It uses a triangular member in place of the curved member. The triangular member is made up of a first and second components 200 and 202. Component 200 is either an L shaped member or made up of members that are integrally connected into such a shape. One end of component 200 is clamped by clamping means 206 to the upper end of the handle portion of a golf club. The other end of member 200 is adjustablely connected to one end of the second component 202.

The other end of the second component is clamped to the lower end of the handle portion by clamping means 208. In FIG. 9, this is accomplished by sliding component 202 into component 200. They are held in place by set screw 209. A first member 212 is connected to one of the components and at least one weight 214 is located over the first member. A means for retaining the weight such as a pin 218 and washer 220 is located below the weight to keep the weight in place. As mentioned before, if the first member 212 is not long enough to obtain the proper distance of the weight below the golfer's hands, a second member 216 may be adjustably connected to the first member in the same fashion as described above.

Figure 15:
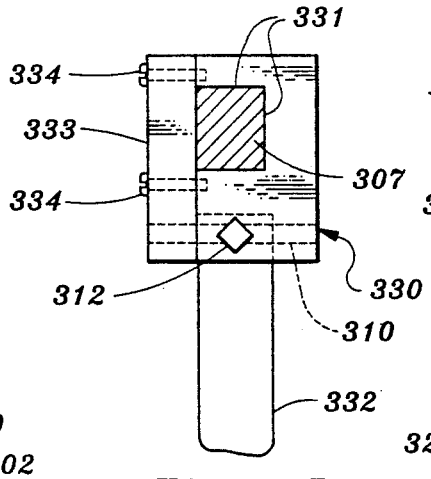
FIG. 15 illustrates a side view taken along section lines 15—15 in FIG. 14.
Figure 13:
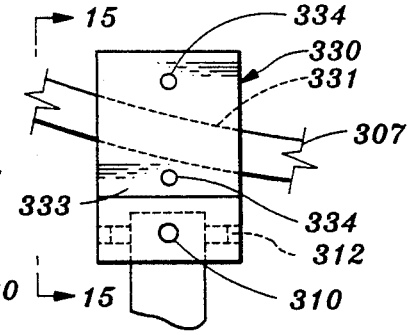
FIG. 13 illustrates an embodiment of my invention wherein the weights are inserted over the top of the vertical member.
Figure 13:
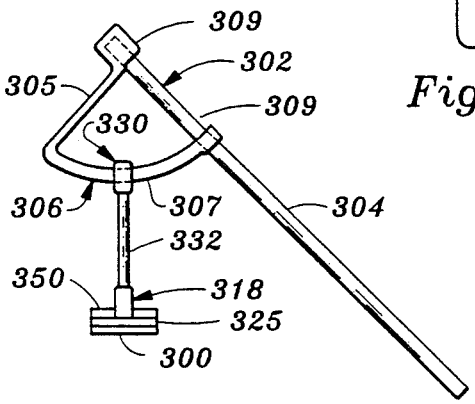
Figure 14:
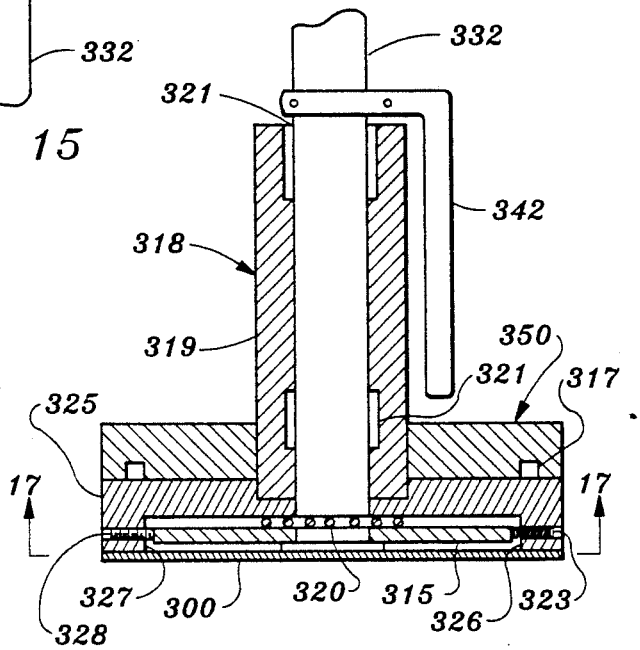
FIG. 14 is a vertical cross section of the embodiment illustrated in FIG. 13.

In addition to the other embodiments described, I now will set forth a few others. One is a combination illustrated in FIG. 13. It comprises a shaft such as a golf club, tubular member that extends just past a handle portion or an elongated shaft 304. A portion of the tubular member will be gripped by the user at location referred to in the claims as a handle portion 302. The combination includes a structural member 306 having two ends and an arcuate portion 307. From FIG. 13 you will see that the arcuate portion 307 of the structural member 306 is contiguous with an angular barlike section 305. The non-contiguous ends of the structural member are connected to the handle portion of the elongated shaft by connecting means 309. They are removable clamp means. On the arcuate portion 307 of the structural member 306 is located a slidably adjustable means 330 for adjustablely locating a downwardly extending member 332 which is connected to the slidably adjustable means. (The downwardly extending member is also referred in the claims as a first member.) The slidably adjustable means 330 may be a metal block, FIGS. 14 and 15, that has a grove 331 that conforms to the shape of the arcuate section of the structural member so that the block is slidable along the arcuate portion. The block is held in place when the screws 334 are screwed into the block so that the cover 333 is pressed against the arcuate portion 307. I note that reversing the block so that the grooves engage the arcuate portion 180 degrees from their original position results in additional positions the downwardly extending member may take that may not otherwise be achievable.

The slidably adjustable means allows the user of my invention to locate the weight directly below the hands of the golfer or the user. The method of connecting the downwardly extending member 332 to the slidably adjustable means 330 can be a force fit into the slidably adjustable means or it could be pinned (see pin 310 in FIG. 14) to the slidably adjustable means and held in place by set screws 312.

Figure 17:
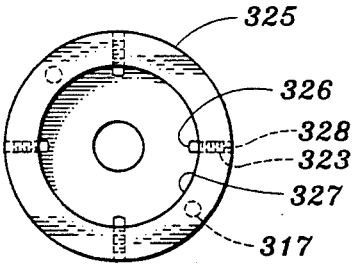
FIG. 17 is a bottom view of horizontal member taken along section line 17—17 in FIG. 14.
Figure 16:
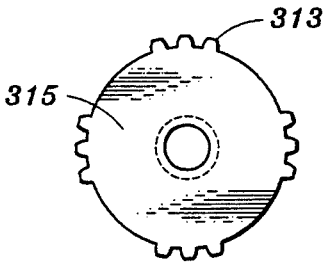
FIG. 16 illustrates in plan view the disk shown in FIG. 14.

As previously mentioned the downwardly extending member supports the weight. It is connected to the slidably adjustable means in a fixed or locked position so that the weight will not move back and forth when my invention is used. A disk 315 is connected to the downwardly extending member. The disk may have uniform projections 313 along its periphery, FIG. 16. Since rotation of the weight is likely to be small, the projections need not be fabricated along the entire periphery of the disk. I illustrate four sections of such projections in FIG. 16. If this is done of course the projections should be centered on the protrusions described below. This disk when used with the assembly 318 can generate sound similar to a rachet wrench. The assembly 318 includes a tubular member 319; the tubular member has a lower end rotatably insertable over the downwardly extending member 332 and a horizontal member 325 connected to the lower end of the tubular member for directly supporting weight 350. (The horizontal member is also referred to in the claims as a first retaining means.) The horizontal member 325 of the assembly 318 has an inner wall 327 (FIG. 17) forming the periphery of a centrally symmetrical hollow bottom portion of the horizontal member, the hollow portion encircles disk 315 so that the horizontal member rotatably rests on disk 315 so that the weight supported by the horizontal member is in turn supported by the disk. The ease of rotating the weights is enhanced by the use of roller bearings 320—but my invention can be used without them.

Along the inner wall are a plurality of protrusions that are formed by ball bearings 326 that extend from the walls. The protrusions or bearings maybe adjustablely extendible towards or away from the center of the hollow portion of the horizontal member so that by extending or retracting the protrusion more or less force is required to rotate the weights. Such adjustments are made by screwing set screws 328 against or away from springs 323. Though a plurality of protrusions are illustrated, a single one may be adequate to generate a sound to indicate the weights have moved and an improper swing has occurred.

As illustrated, the assembly has roller bearings 321 located at the top and the bottom of its tubular member to reduce friction in the rotation of the assembly against the downwardly extending member 332 during the swing by the user of my invention. This makes the invention more sensitive to a swing that is not perfect. The bottom of the assembly may be covered by cover plate 300.

I have also found two different ways to configure the weights themselves. From FIGS. 14 and 17 you will see that I provide protrusions 317 extending upwardly from the horizontal member 325. Though I show the protrusions extending only from the horizontal member, they may likewise extend from each weight. The protrusions fit or engage a hole in the weight above it so that the weight act in unison with the horizontal member. The above describes a means for physically engaging the weights directly located on the horizontal member. If the swing is not too aggressive such protrusions may not be necessary.

Another embodiment of my invention that I describe permits one to use the invention without disassembling the downwardly extending member 332. This is achieved by using the weight shown in FIG. 18. This weight 350 has a section 348 that is removable or insertable as desired. By moving the section 348 towards or away from the center of the weight 350, the ball bearing 337 causes the spring 352 to compress or expand to in turn permit the ball bearing 337 to extend out of or into the socket 346 as the case may be. During a swing, the removable section 348 may further be secured by rotating down a retainer 360. I only describe one way of connecting and reconnecting the removable section. A person skilled in the art will have other ways this may be accomplished. The removable section 348 permits the weights to be removed from my invention without otherwise disassembling it.

I have also provided in one embodiment of my invention markings 344 along the upper most weight and a pointer 342 or indicator on the stationary downwardly extending member 332. The pointer is removably connected to the downwardly extending member so that it can be removed if a weight or the assembly is to be removed. (In the previous embodiments, the pointer may simply be a vertical line etched in the downwardly extending member. For in the other embodiments, the weights are immediately adjacent to the downwardly extending member as opposed to being more distant as in the case when assembly 318 is used.) The markings and pointer may be reversed, that is, the pointer could be located on the weight and the markings could be located on the downwardly extending member. The above describes the means for indicating the amount of rotation and the direction of weight rotation.

Figure 18:
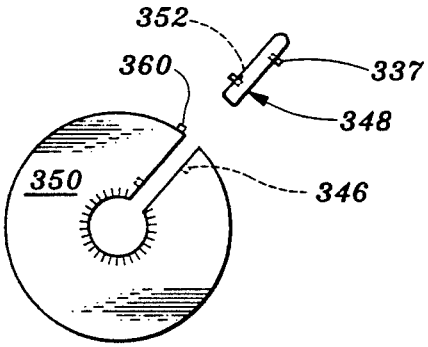
FIG. 18 illustrates a weight that can be inserted sideways onto the vertical member of my invention.

The markings 344 on a weight is illustrated in FIG. 18. Though the markings are illustrated on the weight with the removable section, they of course could be placed on any other type of weight used with my invention or any other part of my invention which rotates directly with the weight. The markings and the pointer are used as follows. By noting before and after a swing the position of the pointer and a marking, the user can determine if the user would be slicing or hooking a golf ball if one were being hit. For example, for a right hand user, if the markings moved clockwise from the pointer, a hook would result. On the other hand, if the markings moved to the left of the pointer or counterclockwise, a slice would result. With this knowledge, the user may be able to make the corrections necessary to result in the "perfect swing." In addition to these aspects of this embodiment, the electrical means for generating a sound or light described above may also be connected and used with this embodiment.

To repeat, my invention is clamped to a golf club so that when the combination is swung by a golfer in practice, the club and my invention swing in parallel planes automatically resulting in a correct half swing which can be changed only with the exertion of force to change its path. The momentum of the pendulum carries the golfer's swing in a natural motion through the golf ball—properly turning the waist at the appropriate time so that by just swinging a club to which my invention is connected a good half swing and rhythm is developed so that it becomes a part of the golfer's natural swing. My invention also develops the strength and balance to result in the proper angle of attack and resulting squareness of contact with the ball. Additionally the muscle development will result in additional strength to increase the speed of the club.

In addition to the above described embodiments of my invention, which may be called "attachment embodiments" or "attachments", the scope of my invention also embraces a class of embodiments which may be called "trainer embodiments" or "trainers", i.e., embodiments of my invention which are self-contained and thus do not require the provision of a golf club for their use.

A trainer embodiment of my invention, i.e., a trainer of my invention, is shown in FIGS. 19 through 26, and described hereinbelow in connection with those figures.

Figure 19:
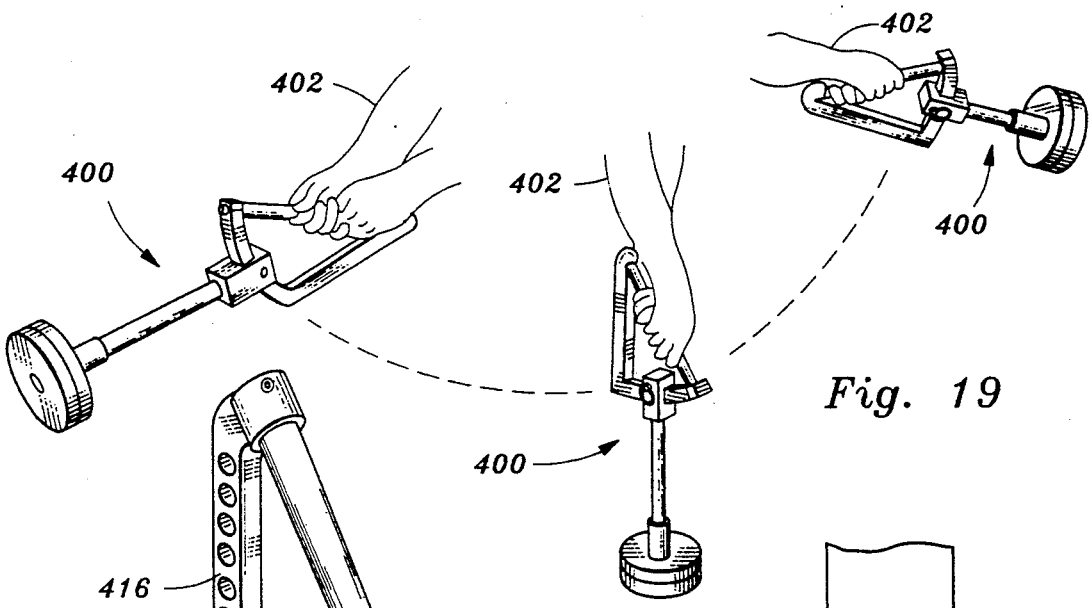
FIG. 19 illustrates the mode of employment of a golf stroke training device of a trainer embodiment of my invention.

Referring now to FIG. 19, there is shown a trainer 400 of my invention being used by a golfer 402 in accordance with the golf stroke training method of my invention.

As explained hereinabove in connection with the description of certain attachment embodiments of my invention, the golfer who uses my invention repeatedly swings the golf stroke training apparatus thereof in a pendulous manner until a correct swing becomes the natural swing of the user.

As seen in FIG. 19, the same method is employed in golf stroke training by means of a trainer embodiment of my invention.

Figure 20:
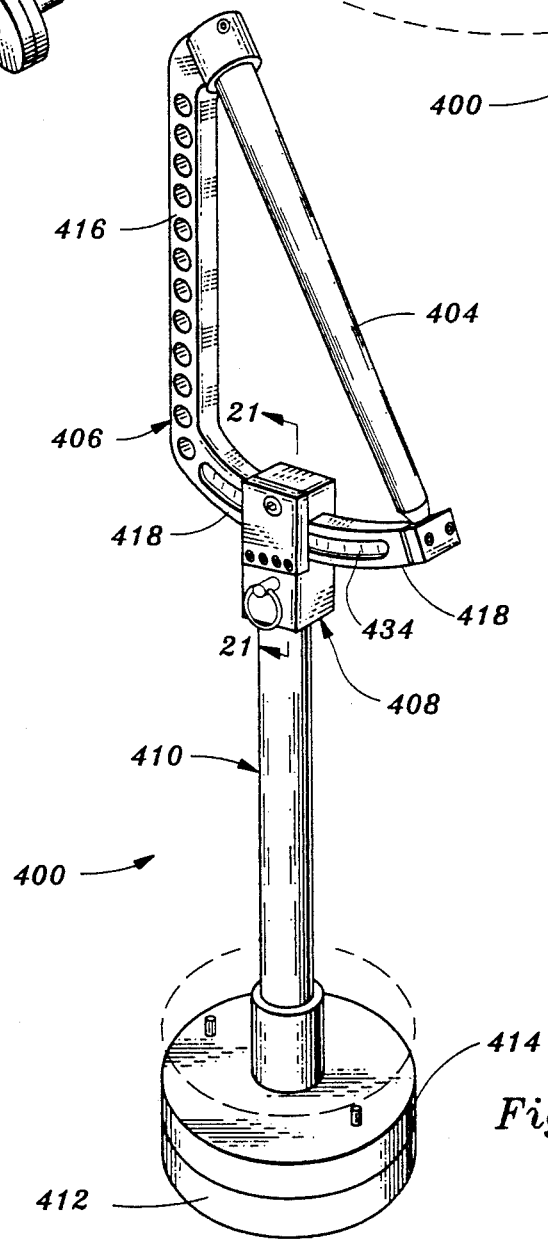
FIG. 20 is a perspective view of the golf stroke trainer embodying my invention which is shown in FIG. 19.

As may be seen by comparing FIGS. 19 and 20 with prior FIGS. 1, 2 and 3, trainer 400 differs from the above disclosed attachment embodiments of my invention in that it is provided only with a handle 404 (FIG. 20), and is not provided with a golf club head or shaft.

This difference in structure provides a far greater advantage than the mere difference in cost attendant upon the elimination of the golf club head and shaft.

I have learned that in the actual practice of my invention the optimum duration of each alternate day practice session is from fifteen to thirty minutes (the total weight of the disc weights used being between five pounds and seventy-five pounds).

Since each practice session is of so short a duration it can be carried out during the working day for example during the user's lunch hour.

Thus, it is desirable that the user be able to immediately commence each such practice session without leaving his office or shop.

As seen in FIG. 20, trainer 400 is free-standing, in the sense that it can be stood upright on the floor in the corner of an office or shop until the user picks it up by handle 404, ready for immediate use.

Many offices, shops, libraries, conference rooms, and the like provide spaces in which trainer 400 can be swung for golf stroke training in accordance with the method of my invention as shown in FIG. 19, because a golf club shaft and head does not project therefrom.

Conversely, many offices, shops, etc., do not provide sufficient room to safely swing attachment-equipped golf clubs of my invention, such as shown in FIGS. 1, 2, and 3, because of the projecting shaft and head of the golf club.

Thus, it will be seen that the elimination of the golf club shaft and head which is a feature of the trainer embodiments of my invention is of great practical importance because it makes golf stroke training in accordance with my invention available to many potential users who have limited office or shop space, and who would not find it feasible to go to a relatively remote location each day for training.

This feature of the trainer embodiments of my invention is particularly important because of the great desirability of training on the days on alternate days when the user does not play golf at a golf course.

Medical authorities have warned against the common practice of indulging in exercise, such as playing golf, but once weekly.

By the use of a trainer embodiment of my invention, however, which can be used in a very limited space, thus economizing transit time, and need be used for but fifteen to thirty minutes per day, every other day, many golfers can exercise the muscles involved in the execution of a correct golf stroke every day or every other day, and thus can avoid the hazards arising from once-weekly exertion of that same set of muscles.

It is to be noted that the regular user of a trainer embodiment of my invention will soon work his way up to total disc weight in the range of twenty to eighty pounds, and will experience full muscle "burn in" during each such brief practice session, thus achieving the desired aerobic affect.

Referring now to FIG. 20, it will be seen that golf stroke trainer 400 is comprised of handle 404, a yoke 406, a clamp 408, a shaft 410, a weight platform 412, and a plurality of weights 414.

As further seen in FIG. 20, yoke 406 is comprised of two integral parts, an elongated substantially straight member or arm 416, and a curvilinear member or arc 418.

As best seen in FIGS. 22 through 24, handle 404 is affixed to yoke 406 by means of clamps 420 and 422.

As seen in FIG. 22, clamp 420 is comprised of two opposing clamping members 420', 420" and a cap screw 421 by means of which clamping members 420', 420" can be drawn together.

As also seen in FIG. 22, clamping member 420' is integral with the upper end of arm 416.

As may be seen by comparison of FIGS. 22 and 23, the upper end of handle 404 is received between clamping members 420', 420", which are tightly drawn together around the upper end of handle 404 by means of cap screw 421.

As also seen in FIG. 23, handle 404 is comprised of a central rigid core 404" and an outer resilient covering 404'.

The outer surface of handle 404 has the general contour of a golf club handle, and is covered with a resilient hand grip 404' of the type generally found on the handles of golf clubs.

As also shown in FIG. 22, the lower end of handle 404, which is not covered with resilient gripping material 404', and is somewhat tapered, is clampingly received in clamping assembly 422.

Clamping assembly 422 is comprised of an inner clamping member 422', an outer clamping member 422", and a pair of cap screws 423', and 423".

As best seen in FIG. 24, the lower end of handle core 404" is clampingly received between clamping members 422' and 422", which clamping members are tightly drawn together by cap screws 423', 423".

As may be seen by comparison of FIGS. 22 and 24, inner clamping member 422' is integral with the rightmost end of arc 418.

As best seen in FIG. 22, yoke 406 is provided with a plurality of lightening holes 424 whereby yoke 406 is made as light in weight as possible while at the same time retaining the necessary strength to fixedly and safely support weights 414 with respect to handle 404 during the execution of the golf stroke training method of my invention.

By comparison of FIGS. 20, 21 and 22, the construction and operation of weight shaft clamp 408 will now be described.

Figure 21:
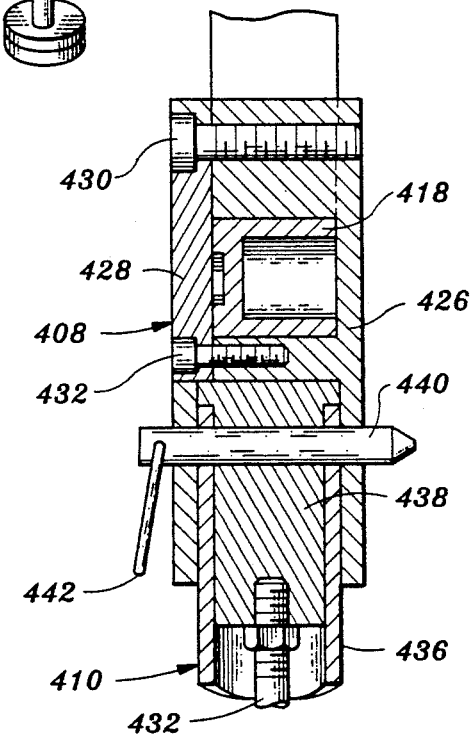
FIG. 21 is a partial cross-sectional view of the golf stroke trainer of my invention shown in FIG. 20, taken on plane 21—21 of FIG. 20.

As particularly seen in FIGS. 21 and 22, arc 418 of yoke 406 passes through weight shaft clamp 408 and is close-fittingly received therein.

Weight shaft clamp 408 is comprised of two principal parts, viz., body 426 and cover plate 428. Cover plate 428 is tightly secured to body 426 by means of a principal cap screw 430 and four minor cap screws 432.

When all five cap screws are fully tightened, weight shaft clamp 408 is frictionally secured to arc 418 at one particular selected place, and cannot be moved along arc 418 until at least cap screw 430 is loosened, i.e., partly withdrawn from its clamping position.

The parts of clamp 408 are so constructed and arranged that when cap screw 430 is loosened weight shaft clamp 408 can be moved along arc 418 to a new position.

For convenient positioning of weight shaft clamp 408, arc 418 is provided with a scale 434. Scale 434 is graduated in accordance with the lie angle of various clubs, i.e., in accordance with the angle which would be assumed by handle 404 if it were the handle of a particular golf club and that golf club were positioned for the execution of a correct stroke.

When weight shaft clamp 408 has been properly positioned on arc 418 in accordance with the lie angle of a club for which the user is to be trained, clamp 408, and thus weight shaft 410, can be clamped to arc 418 by tightening cap screw 430.

As best seen in FIG. 21, weight shaft 410 is generally comprised of an inner rod 434 and an outer tube 436, the upper ends of which are joined by a spacer block 438.

As also seen in FIG. 21, weight shaft 410 is joined to clamp 408 by means of a pin 440, headed with a ring 442, which pin passes through registered holes in clamp body 426, tube 436, and spacer block 438 and is frictionally engaged therein.

Figures 25, 26:
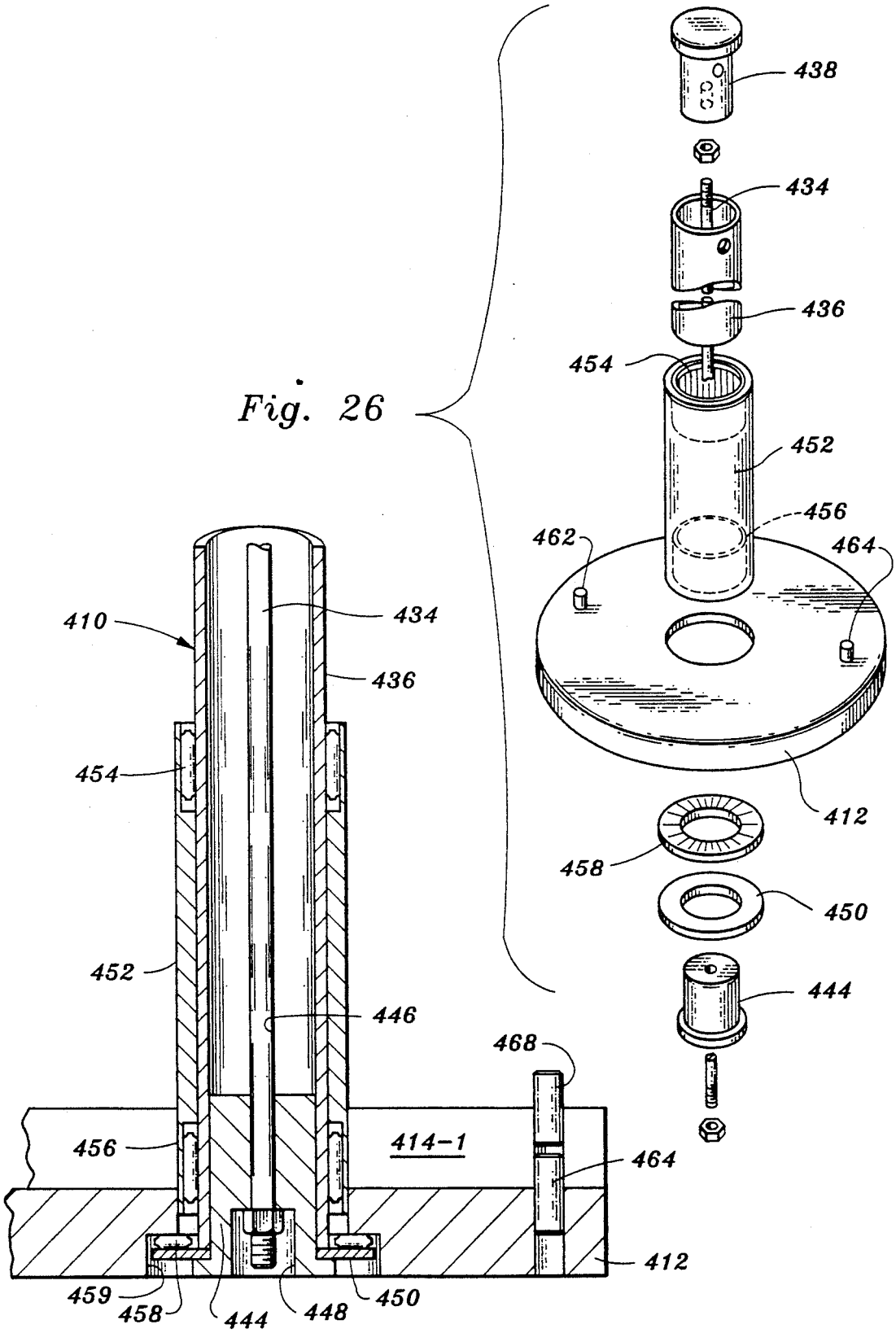
FIG. 25 is a partial cross-sectional view in elevation of the golf stroke trainer of my invention which is shown in FIG. 20.
FIG. 26 is an exploded partial view of the parts of the golf stroke trainer of my invention which is shown in FIG. 25.

Referring now to FIGS. 25 and 26, there is shown the lower end of weight shaft 410 and the anti-friction bearings of weight platform 412 of this embodiment. It is to be understood, however, that not all of the trainer embodiments of my invention will be identical in structure to the trainer embodiment of my invention illustrated in FIGS. 19 through 26, and in particular that not of the all trainer embodiments of my invention will be provided with the weight platform anti-friction system shown in FIGS. 25 and 26.

As particularly shown in FIG. 25, the respective ends of rod 434 and tube 436 of weight shaft 410 are joined by means of a spacer block 444. Spacer block 444 is of generally cylindrical configuration and is adapted to be largely received within the lower end of tube 436. Further, spacer block 444 is provided with a central bore 446 which receives the lower end of rod 434, and with a cylindrical cavity 448 which contains the lower end of rod 434 and the nut by means of which spacer block 444 is retained in its operative position as shown in FIG. 25.

As also shown in FIG. 25, the lower end of spacer block 444 is provided with an outwardly projecting flange which serves to clamp a discate retaining member 450 against the lower end of tube 436.

An outer tubular member 452 is close-fittingly received in a cylindrical cavity in the upper face of weight platform 412, and is retained therein by means the provision of which is within the scope of those having ordinary skill in the art.

As further seen in FIG. 25, a roller bearing set 454 is interposed between the upper end of outer tubular member 452 and tube 436. Similarly, an additional roller bearing set 456 is interposed between the lower end of outer tubular member 452 and tube 436. Additionally, a roller bearing set 458 is interposed between retaining member 450 and the inner face of a cylindrical cavity 459 formed in the bottom face of weight platform 412. Thus, it will be understood by those having ordinary skill in the art, informed by the present disclosure, that weight platform 412 is freely rotatable about weight shaft 410.

It is to be understood, however, that the provision of such bearing means to make weight platform 412 freely rotatable about weight shaft 410 is not a necessary feature of all of the embodiments of my invention, and that certain fully operative and useful embodiments of my invention are not be provided with such bearing means. Rather, in these certain trainer embodiments of my invention the weight platform will be irrotatable with respect to the weight shaft.

As further seen by comparison of FIGS. 25 and 26, weight platform 412 is provided with a pair of pins 462, 464, by means of which the disc weight 414-1 directly disposed upon weight platform 412 (FIG. 25) is rendered irrotatable with respect to weight platform 412.

As also seen in FIG. 25, disc weight 414-1 is provided with an upwardly projecting pin 468 and an upwardly projecting pin 470 (not shown) by means of which the weight 414-2 borne directly by it, if used, is rendered irrotatable with respect to disc weight 414-1.

It is to be understood that in the particular embodiment of my invention illustrated in FIGS. 19 through 26 each disc weight of the associated weight set is provided with pins similar to pins 468, 470, and holes similar to the holes in which pins 462, 464 are received. It is to be understood, however, that this is not a necessary feature of my invention, and that the disc weights of many alternative embodiments of my invention will be unprovided with such aligning pins and holes.

The foregoing description and drawings will suggest other embodiments and variations within the scope of the claims to those skilled in the art, all of which are intended to be included in the spirit of the invention as herein set forth.

I claim:

1. A combination comprising a shaft having an upper and lower end, a handle portion having two ends, the handle portion located at the upper end of the shaft, and a golf swing muscle strengthener and swing developer device, said device including at least one weight; a structural member connected to the handle portion; means for connecting the structural member to the club; said structural member extending from the handle portion of the shaft to a position directly below where a user grips the shaft; the weight insertable onto the structural member and lowered to the lower end of the structural member so that the weight is directly below a user's hands while the user swings the lower end of the shaft square to a swing line; a first means for retaining the weight, said first retaining means located below the weight.

2. The combination of claim 1 wherein the structural member is made of at least two portions and further includes a means for interconnecting the two portions of the structural members.

3. The combination of claim 1 further including a means for generating a sound that corresponds to a twisting movement of the weight.

4. The combination of claim 1 further including means for generating a light that corresponds to a twisting movement of weight.

5. The combination of claim 4 wherein said means for generating a light further includes a means for generating a sound.

6. The combination of claim 1 further including a second removable means for retaining the upper end of the weight, said removable means insertable onto the structural member before the weight.

7. The combination of claim 1 wherein the structural member is a member having two ends, and the means for connecting the structural member to the shaft includes a first and second means for clamping the member to each end of the handle portion; said combination further including a downwardly extending member extending downwardly wherein said weight is locatable thereon above the first retaining means which is located below the weight, and a slidably adjustable means for adjustablely connecting the slidable means and the downwardly extending member to the structural member.

8. The combination of claim 7 further including a means for generating a sound that corresponds to a twisting movement of the weight.

9. The combination of claim 8 wherein the first retaining means of the combination has an inner wall forming the periphery of a centrally symmetrically hollowed portion of the first retaining means; the inner wall having at least one protrusion extending from the inner wall towards the center of the hollowed portion of the retaining means; the means for generating a sound that corresponds to the twisting movement of the weight includes a disc with projections along the periphery of the disc so that when the disc rotates the projections contact the protrusion so as to generate a sound that corresponds to the rotation of the weight, the disc connected to the end of the downwardly extending member.

10. The combination of claim 9 further including means for generating a light that corresponds to a twisting movement of weight.

11. The combination of claim 10 wherein said protrusion are adjustable so as to be able to increase or decrease the force necessary to rotate the weight.

12. The combination of claim 7 further including a removable means for retaining the upper end of the weight, said removable retaining means insertable onto the structural member so that the removable retaining means is located above the weights.

13. A combination comprising a shaft having an upper and lower end, a handle portion having two ends, the handle portion located at the upper end of the shaft and a golf swing muscle strengthener and swing developer device, said device including a member having an arcuate portion and two ends, a first and second means for clamping the arcuate member to each end of the handle portion; a first member; a means for adjustablely connecting the first member to the arcuate member; at least one weight insertable onto the first member; a first means for retaining the weight, said retaining means located below the weight; and wherein the means for adjustablely connecting the first member to the curved member is adjusted so that the weight is directly below a user's hands while the user takes a stance to commence a swing in a plane so the lower end of the shaft is square to the swing line throughout the swing.

14. The combination of claim 13 further including a second removable means for retaining the upper end of the weight, said second removable means insertable onto the first member before the weight.

15. The combination of claim 13 wherein the arcuate member has a plurality of holes and the first member has a curved upper portion having a plurality of holes and the means for adjustablely connecting the first member to the arcuate member includes at least one bolt and nut, wherein the bolt passes through a hole in both the arcuate member and the first member and the nut is secured to the bolt.

16. The combination of claim 13 wherein the means for adjustablely connecting the first member to the arcuate member is a pair of serrated members having serrations projecting from one side of each serrated member and a hole located centrally in each serrated member wherein one serrated member is secured to the arcuate member and the other serrated member is secured to the first member so that the serrations projecting from each serrated member engage; a nut and a bolt wherein the bolt passes through the hole in each of the serrated members so that when the proper location of the weight is found, the bolt is located into the hole of each serrated member and secured by tightening the nut against the bolt that passes through the hole of each of the serrated members.

17. The combination of claim 13 wherein the means for adjustablely connecting the first member to the arcuate member is a rotatable gear and a gear rack that engage each other and are connected to the arcuate and first member so that when the rotatable gear is rotated the gear moves along the gear rack so in turn the weight can be located below the user's hands.

18. The combination of claim 13 further including a means for generating a sound that corresponds to a twisting movement of the weight.

19. The combination of claim 18 wherein said means for generating a light further includes a means for generating a sound.

20. The combination of claim 13 further including means for generating a light that corresponds to a twisting movement of weight.

21. A combination comprising a golf club having a shaft having a lower and upper end, a handle portion having two ends located at the upper end of the shaft, a club head at the lower end of the shaft and a golf swing muscle strengthener and swing developer device, said device including a first component having an L shaped configuration having two free ends, a second component having two free ends, a pair of clamping means for adjustablely securing each component at one of each component's free ends to each end of the handle portion so that the other free end of each component points to the free end of the other component, a means for adjustablely securing the other free end of the first component to the other free end of the second component in a predetermined location, a first member connected to one of the components so that when the components are adjusted the first member will be adjusted accordingly, at least one weight insertable onto the first member, a first means for retaining the weight, said retaining means located below the weight.

22. The combination of claim 21 further including a second removable means for retaining the upper end of the weight, said second removable retaining means insertable onto the first member before the weight.

23. The combination of claim 21 wherein a second member is adjustablely connected the first member; a means for adjustablely connecting the second member to the first member so that the second member performs as an extension of the first member.

24. The combination of claim 21 further including a means for generating a sound that corresponds to a twisting movement of the weight.

25. The combination of claim 21 further including means for generating a light that corresponds to a twisting movement of the weight.

26. The combination of claim 21 wherein said means for generating a light further includes a means for generating a sound.

27. A combination comprising a shaft having an upper and lower end and a handle portion located at the upper end of shaft in combination with at least one weight, a structural member having two ends and an arcuate portion;

means for connecting the structural means at each end of the handle portion of the shaft;

a downwardly extending member for supporting the weight, said extending member having an upper and lower end;

an adjustable means for adjustablely locating the downwardly extending member so that the weight may be located directly below the hands of the user of the combination, said adjustable means connected to the downwardly extending member and slidably connected to the arcuate portion of the structural member so that when weight is fixed in a position below hands of the user by the adjustable means;

a disk connected to the downwardly extending member, said disk connected to the lower end of the downwardly extending member, said disk having projections along the periphery of the disk;

an assembly including a tubular member, said tubular member having a lower end rotatably insertable over the downwardly extending member; the assembly further having a horizontal member connected to the lower the lower end of the tubular member for directly supporting weights, said assembly lowered down the downwardly extending member so that the assembly rests on the disk;

the horizontal member having a bottom portion and an inner wall forming the periphery of a symmetrical hollow portion in the bottom portion of the horizontal member, the hollow portion encircling and rotatably resting on the disk so that the weight supported by the horizontal member is in turn supported by the disk;

at least one protrusion extending from the inner wall of the horizontal member towards the center of the hollow portion of the horizontal member so that when the movement of the weight causes the assembly to rotate, the assembly in turn causes the protrusion to rub against the projections of the disk in turn causing a sound to be generated whereby a user of the combination realizes that the user's swing would have resulted in a golf ball to be sliced or hooked if the combination had been used to hit the golf ball.

28. The combination of claim 27 where said protrusion is adjustablely extendible towards and away from the center of the hollow portion of the horizontal member so that by extending the protrusion more force is required to rotate the weight.

29. The combination of claim 28 wherein said horizontal member of the assembly further has a means for physically engaging the weight directly located on the horizontal member so that each weight rotates in unison with the horizontal member if the swing of the combination is not in a straight line.

30. The combination of claim 27 wherein the combination further includes a means for indicating the amount and direction of weight rotation.

31. The combination of claim 27 wherein the weight includes a removable section so as to allow the weight to be located onto or remove from the combination without otherwise disassembly of the combination.

32. Golf stroke training apparatus, comprising:

handle means having an axis and being of sufficient length to be grasped by both of the hands to an adult golfer in an interlocked hand grip;

handgrip means covering at least part of said handle means;

weight means which are adjustable in weight and are symmetrical about an axis of symmetry; and weight supporting means capable of supporting said weight means in a fixed position and orientation with respect to said handle means so that said axis of symmetry passes through said handgrip and the angle between said handle axis and said axis of symmetry remains fixed when said golf stroke training apparatus is swung by a golfer in practice, and said angle lies between 25 degrees and 40 degrees.

33. Golf stroke training apparatus as claimed in claim 32 wherein said angle between said handle axis and said axis of symmetry is adjustable.

34. Golf stroke training apparatus as claimed in claim 23 in which the maximum weight of said weight means exceeds fifty pounds.

35. Golf stroke training apparatus as claimed in claim 32 in which the maximum weight of said weight means exceeds fifty pounds.

36. Golf stroke training apparatus as claimed in claim 33 in which the maximum weight of said weight means exceeds ten pounds.

37. Golf stroke training apparatus as claimed in claim 32 in which the maximum weight of said weight means exceeds ten pounds.

* * * * *